US007983598B2

(12) United States Patent
Shinshi et al.

(10) Patent No.: US 7,983,598 B2
(45) Date of Patent: Jul. 19, 2011

(54) FIXING DEVICE AND IMAGE FORMING APPARATUS

(75) Inventors: Akira Shinshi, Machida (JP); Hiroshi Yoshinaga, Ichikawa (JP)

(73) Assignee: Ricoh Company, Ltd., Tokyo (JP)

( * ) Notice: Subject to any disclaimer, the term of this patent is extended or adjusted under 35 U.S.C. 154(b) by 135 days.

(21) Appl. No.: 12/385,101

(22) Filed: Mar. 31, 2009

(65) Prior Publication Data

US 2009/0245865 A1 Oct. 1, 2009

(30) Foreign Application Priority Data

Mar. 31, 2008 (JP) ..... 2008-090817
Sep. 19, 2008 (JP) ..... 2008-240574

(51) Int. Cl.
*G03G 15/16* (2006.01)

(52) U.S. Cl. ..... 399/122

(58) Field of Classification Search ..... 399/122, 399/320, 328, 329
See application file for complete search history.

(56) References Cited

U.S. PATENT DOCUMENTS 4,110,068 A 8/1978 Brown et al.
5,559,593 A 9/1996 Yoshinaga et al.
5,887,224 A 3/1999 Mizuishi et al.
5,915,143 A 6/1999 Watanabe et al.
6,006,050 A 12/1999 Watanabe et al.
6,026,273 A * 2/2000 Kinouchi et al. ..... 399/328
6,055,388 A 4/2000 Watanabe et al.
6,055,394 A 4/2000 Suda et al.
6,101,351 A 8/2000 Suda et al.
6,208,826 B1 3/2001 Yoshinaga et al.
6,256,465 B1 7/2001 Yoshinaga et al.
6,334,039 B1 12/2001 Yoshinaga et al.
6,336,013 B1 1/2002 Suda et al.
6,366,754 B1 4/2002 Sato et al.
6,470,161 B2 10/2002 Fujishiro et al.
6,505,022 B2 1/2003 Kosuge et al.
6,546,219 B2 4/2003 Sato et al.
6,628,916 B2 9/2003 Yasui et al.
6,636,709 B2 10/2003 Furukawa et al.
6,778,790 B2 8/2004 Yoshinaga et al.
6,778,797 B2 8/2004 Sato et al.
6,778,804 B2 8/2004 Yoshinaga et al.

(Continued)

FOREIGN PATENT DOCUMENTS

JP 6-99055 12/1994

(Continued)

OTHER PUBLICATIONS

Abstract of JP 04-121337 published Apr. 22, 1992.

(Continued)

*Primary Examiner* — Sandra L Brase
(74) *Attorney, Agent, or Firm* — Harness, Dickey & Pierce, P.L.C.

(57) ABSTRACT

A fixing device includes a rotatable fixing member, a pressing member, a drive input rotating body, a first frame, a support shaft, and at least one positioning member. The pressing member contacts the fixing member to form a fixing nip therebetween. The drive input rotating body receives an external driving force and transmits the driving force to the fixing member. The first frame supports the fixing member and the pressing member. The support shaft is provided on the first frame to support the drive input rotating body. At least one positioning member is supported by an image forming apparatus body when the fixing device is installed in the image forming apparatus body.

19 Claims, 11 Drawing Sheets

U.S. PATENT DOCUMENTS

| | | | | |
|---|---|---|---|---|
| 6,785,505 | B2 | 8/2004 | Yasui et al. | |
| 6,881,927 | B2 | 4/2005 | Yoshinaga et al. | |
| 6,882,820 | B2 | 4/2005 | Shinshi et al. | |
| 6,892,044 | B2 | 5/2005 | Yasui et al. | |
| 6,977,022 | B2 | 12/2005 | Sato et al. | |
| 7,022,944 | B2 | 4/2006 | Yoshinaga et al. | |
| 7,127,204 | B2 | 10/2006 | Satoh et al. | |
| 7,151,907 | B2 | 12/2006 | Yoshinaga | |
| 7,239,838 | B2 | 7/2007 | Sato et al. | |
| 7,242,897 | B2 | 7/2007 | Satoh et al. | |
| 7,313,353 | B2 | 12/2007 | Satoh et al. | |
| 7,330,682 | B2 | 2/2008 | Shinshi | |
| 7,344,615 | B2 | 3/2008 | Sato et al. | |
| 7,379,698 | B2 | 5/2008 | Yoshinaga | |
| 7,406,276 | B2 * | 7/2008 | Mimura et al. | 399/122 |
| 7,454,151 | B2 | 11/2008 | Satoh et al. | |
| 2001/0012460 | A1 | 8/2001 | Sato et al. | |
| 2001/0017995 | A1 | 8/2001 | Sato et al. | |
| 2001/0053298 | A1 | 12/2001 | Fujishiro et al. | |
| 2002/0018663 | A1 | 2/2002 | Furukawa et al. | |
| 2002/0067936 | A1 | 6/2002 | Yasui et al. | |
| 2003/0000933 | A1 | 1/2003 | Yoshinaga et al. | |
| 2003/0007813 | A1 | 1/2003 | Yasui et al. | |
| 2003/0016963 | A1 | 1/2003 | Yoshinaga et al. | |
| 2003/0083180 | A1 | 5/2003 | Sato et al. | |
| 2003/0206758 | A1 | 11/2003 | Yasui et al. | |
| 2003/0215271 | A1 | 11/2003 | Yoshinaga et al. | |
| 2004/0013453 | A1 | 1/2004 | Shinshi et al. | |
| 2005/0025539 | A1 | 2/2005 | Yoshinaga | |
| 2005/0095043 | A1 | 5/2005 | Yoshinaga et al. | |
| 2005/0163543 | A1 | 7/2005 | Satoh et al. | |
| 2006/0002737 | A1 | 1/2006 | Shinshi | |
| 2006/0032581 | A1 | 2/2006 | Sato et al. | |
| 2006/0116230 | A1 | 6/2006 | Satoh et al. | |
| 2006/0165429 | A1 | 7/2006 | Satoh et al. | |
| 2006/0165443 | A1 | 7/2006 | Yoshinaga et al. | |
| 2006/0165448 | A1 | 7/2006 | Yoshinaga | |
| 2006/0257183 | A1 | 11/2006 | Ehara et al. | |
| 2007/0003334 | A1 | 1/2007 | Shinshi et al. | |
| 2007/0014603 | A1 | 1/2007 | Satoh et al. | |
| 2007/0059003 | A1 | 3/2007 | Shinshi et al. | |
| 2007/0059071 | A1 | 3/2007 | Shinshi et al. | |
| 2007/0110464 | A1 | 5/2007 | Nakayama et al. | |
| 2007/0166085 | A1 | 7/2007 | Shinshi | |
| 2007/0292175 | A1 | 12/2007 | Shinshi | |
| 2008/0063443 | A1 | 3/2008 | Yoshinaga et al. | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0253788 | A1 | 10/2008 | Shinshi | |
| 2008/0253789 | A1 | 10/2008 | Yoshinaga et al. | |
| 2008/0298862 | A1 | 12/2008 | Shinshi | |
| 2008/0317532 | A1 | 12/2008 | Ehara et al. | |

FOREIGN PATENT DOCUMENTS

| | | | |
|---|---|---|---|
| JP | 2538376 | | 3/1997 |
| JP | 2000-147978 | | 5/2000 |
| JP | 2001-005240 | | 1/2001 |
| JP | 2002-173212 | | 6/2002 |
| JP | 3708826 | | 8/2005 |
| JP | 2006-163305 | * | 6/2006 |

OTHER PUBLICATIONS

Abstract of JP 2002-220107 published Aug. 6, 2002.

European Search Report dated Mar. 22, 2010 for corresponding European Application No. 0925084037.

* cited by examiner

FIXING DEVICE AND IMAGE FORMING APPARATUS

PRIORITY STATEMENT

The present patent application claims priority from Japanese Patent Application Nos. 2008-090817, filed on Mar. 31, 2008, and 2008-240574, filed on Sep. 19, 2008 in the Japan Patent Office, the entire contents of each of which are hereby incorporated herein by reference.

BACKGROUND OF THE INVENTION

1. Field of the Invention

Example embodiments generally relate to a fixing device and an image forming apparatus, for example, for efficiently fixing a toner image on a recording medium using a rotatable fixing member.

2. Description of the Related Art

Image forming apparatuses, such as copiers, facsimile machines, printers, and multifunction devices having at least one of copying, printing, scanning, and facsimile functions, typically form a toner image on a recording medium (e.g., a sheet) based on image data using electrophotography.

For example, when an electrostatic latent image is formed on a surface of a photoconductor, serving as an image carrier, a development device develops the electrostatic latent image with a developer (e.g., toner) into a visible toner image. After a transfer device transfers the toner image onto a sheet, the toner image is fixed on the sheet by heat and pressure applied by a fixing device. Then, the sheet is discharged to the outside of the image forming apparatus via a discharge path.

FIGS. 1A and 1B illustrate one example of a related-art fixing device 900R. Left and right side plates 97A and 97B are vertically provided on a bottom plate 97C, as illustrated in FIG. 1B, and support a fixing roller 11R, a heating roller 14R, and a pressing roller 13R, respectively, as illustrated in FIG. 1A. A fixing belt 12R is wrapped around the fixing roller 11R and the heating roller 14R under an appropriate amount of tension supplied by a tension roller 15AR. The side plates 97A and 97B are reinforced by the bottom plate 97C, stays, and the like, so as to keep the respective rollers parallel to each other.

Since the fixing device 900R is detachably attached to the image forming apparatus, positioning members 98A and 98B engage a supporting member of the image forming apparatus so that the fixing device 900R is positioned in a predetermined place. The positioning members 98A and 98B are fixed to the side plates 97A and 97B by swaging and extend from a fixing cover 900C.

The right side plate 97A supports a drive input gear 99A with a support shaft, not shown, provided outside the fixing device 900R. The drive input gear 99A, serving as a drive input rotating body, receives a driving force transmitted from the outside (the image forming apparatus). A rotary shaft of the pressing roller 13R extends from the right side plate 97A. A pressing roller gear 99C is provided at one end of the rotary shaft of the pressing roller 13R in an axial direction of the rotary shaft.

Upon receipt of the driving force transmitted from the image forming apparatus, the drive input gear 99A rotates. When the rotation of the drive input gear 99A is transmitted to the pressing roller gear 99C via an idler gear 99B, the pressing roller 13R rotates. The fixing belt 12R is driven to rotate as the pressing roller 13R rotates.

When the fixing device 900R is attached to the image forming apparatus, a user moves the fixing device 900R in a direction perpendicular to shaft lines of the positioning members 98A and 98B, with a surface of the fixing device 900R on which a drawer connector 9A is provided facing toward the back of the image forming apparatus, so that the fixing device 900R is installed in a predetermined position of the image forming apparatus.

What is important here is that the shaft lines of the positioning members 98A and 98B are parallel to both a transfer roller and a registration roller provided in the image forming apparatus and the respective rollers (the fixing roller 11R and the pressing roller 13R) of the fixing device 900R, thereby properly conveying a sheet to a fixing nip formed between the fixing roller 11R and the pressing roller 13R of the fixing device 900R. If the fixing roller 11R and the pressing roller 13R are not positioned parallel to the transfer roller and a registration roller of the image forming apparatus, the sheet is fed unevenly to the feeding device 900R and bent or folded, thereby generating a crease or a difference in scale between left- and right-side images.

FIG. 2A is a sectional view of the fixing device 900R. When the drive input gear 99A receives,a driving force f' from a driving gear 200AR of the image forming apparatus, one part of the force f' is transmitted to the right side plate 97A depicted in FIG. 1B via the support shaft of the drive input gear 99A to lift up the whole fixing device 900R. When this occurs, since the fixing device 900R is supported by the image forming apparatus with the positioning member 98A, a rotational moment m' is generated around the positioning member 98A due to the lifting force, as illustrated in FIG. 2B. Since the fixing device 900R receives the rotational moment m', the right side plate 97A is twisted and deformed, causing the fixing roller 11R supporting the fixing belt 12R to lose its parallel position with respect to the pressing roller 13R opposing the fixing belt 12R. As a result, the fixing belt 12R may shift from a predetermined position in an axial direction of the fixing roller 11R, thereby generating a crease in the sheet.

In order to prevent such shift of a fixing belt, another related-art fixing device includes a supporting roller of the fixing belt to control shifting of the fixing belt. However, the fixing device requires a fixing belt position detector and a component for moving the support roller, thereby increasing both costs and size of the fixing device. In addition, such supporting roller cannot be used for a surf-fixing device in which no tension is applied to a fixing belt. FIG. 3 is a schematic view of a surf-fixing device 300 illustrating a structure thereof. The surf-fixing device 300 includes a fixing belt 32, a pressing roller 33, a ceramic heater 32H, a holder 32A, and a stay 32B. The fixing belt 32 is supported by one shaft, not shown, so that the fixing belt 32 easily loses its parallel position with respect to the pressing roller 33, thereby shifting from a predetermined position.

Accordingly, there is a need for a technology capable of keeping the respective rollers of a fixing device parallel to each other as well as to conveyance rollers of an image forming apparatus so as to prevent a shift of a fixing belt in an axial direction of the rollers.

SUMMARY

At least one embodiment provides a fixing device that includes a rotatable fixing member, a pressing member, a drive input rotating body, a first frame, a support shaft, and at least one positioning member. The pressing member contacts the fixing member to form a fixing nip therebetween. The drive input rotating body receives an external driving force and transmits the driving force to the fixing member. The first frame supports the fixing member and the pressing member. The support shaft is provided on the first frame to support the drive input rotating body. At least one positioning member is supported by an image forming apparatus body when the fixing device is installed in the image forming apparatus body. The positioning member is combined with an end of the support shaft in an axial direction of the support shaft.

Further, at least one embodiment provides an image forming apparatus that includes a fixing device and a supporting member. The fixing device includes a rotatable fixing member, a pressing member, a drive input rotating body, a first frame, a support shaft, and at least one positioning member as described above. The supporting member engages the positioning member of the fixing device to support the fixing device.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1A:
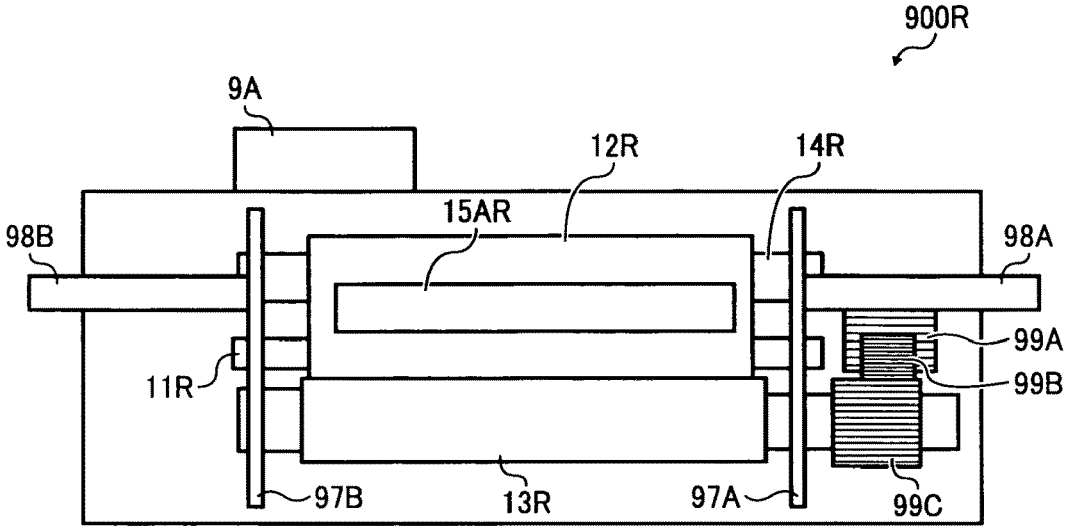
FIG. 1A RELATED ART
FIG. 1A is a schematic top view of a related-art fixing device.
Figure 1B:
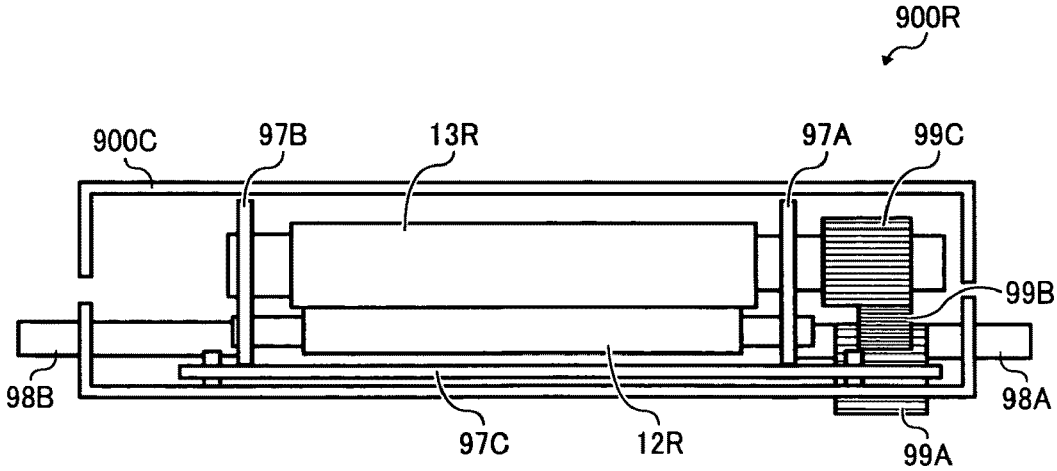
FIG. 1B RELATED ART
FIG. 1B is a schematic front view of the fixing device shown in FIG. 1A.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. By contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements, or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify, the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 4:
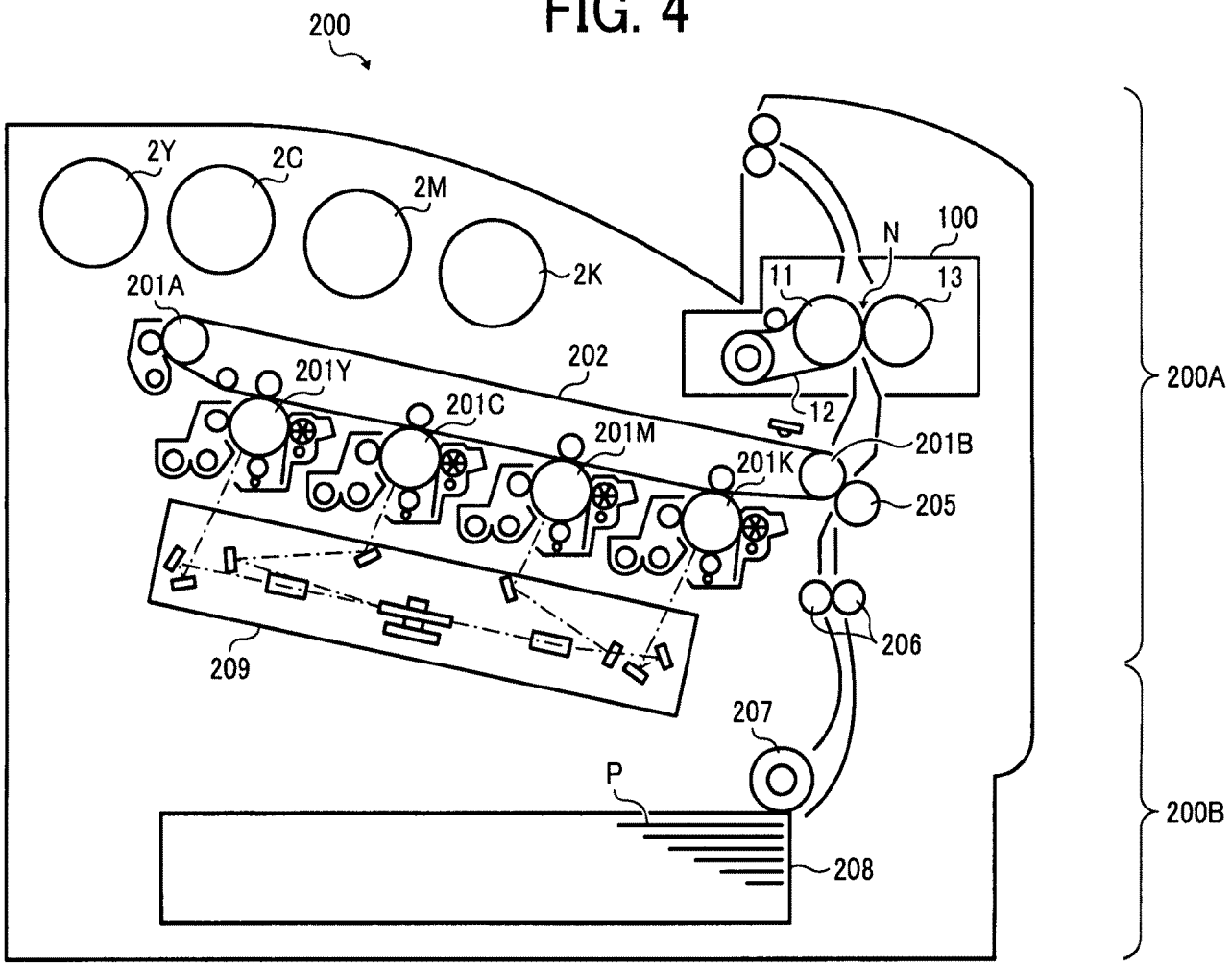
FIG. 4 is a schematic sectional view of an image forming apparatus according to an example embodiment.

Referring now to the drawings, wherein like reference numerals designate identical or corresponding parts throughout the several views thereof, in particular to FIG. 4, the structure of an image forming apparatus 200 according to an example embodiment of the present invention is described.

FIG. 4 is a schematic sectional view of the image forming apparatus 200. The image forming apparatus 200 includes an image forming device 200A and a feeding device 200B. The image forming device 200A includes a fixing device 100, a transfer belt 202, photoconductors 201Y, 201C, 201M, and 201K, an optical writer 209, a driving roller 201A, a driven roller 201B, and a transfer roller 205. The feeding,device 200B includes a paper tray 208 and conveyance rollers 206 and 207. The fixing device 100 includes a fixing roller 11, a fixing belt 12, and a pressing roller 13.

The image forming apparatus 200 may be a copier, a facsimile machine, a printer, a multifunction printer having at least one of copying, printing, scanning, and facsimile functions, or the like. According to this non-limiting example embodiment, the image forming apparatus 200 functions as a tandem-type color copier for forming a color image on a recording medium (e.g., a sheet) by electrophotography. However, the image forming apparatus 200 is not limited to the color copier and may form a color and/or monochrome image in other configurations.

The image forming device 200A is provided in a central portion of the image forming apparatus 200. The feeding device 200B is provided below the image forming device 200A. The fixing device 100 is incorporated in the image forming device 200A.

The transfer belt 202 of the image forming device 200A includes a transfer surface extending in a horizontal direction. The photoconductors 201Y, 201C, 201M, and 201K, serving as image carriers, are provided side by side to oppose a lower circumferential surface (a transfer surface) of the transfer belt 202, respectively, and form and carry yellow, cyan, magenta, and black toner images having a complementary color relationship.

The respective photoconductors 201Y, 201C, 201M, and 201K are drum-shaped and rotatable in the same counterclockwise direction. A charger, the optical writer 209, a primary transfer device, a development device, and a cleaner are provided around the photoconductors 201Y, 201C, 201M, and 201K, and perform image formation in rotation of the photoconductors 201Y, 201C, 201M, and 201K, respectively. The respective development devices store yellow, cyan, magenta, and black toner 2Y, 2C, 2M, and 2K.

The transfer belt 202 is wrapped around the driving roller 201A and the driven roller 201B to oppose the photoconductors 201Y, 201C, 201M, and 201K and move in the same direction. The transfer roller 205 opposes the driven roller 201B. Although a sheet conveyance path from the transfer roller 205 to the fixing device 100 is provided in a vertical direction, the sheet conveyance path may be provided in a lateral direction.

The paper tray 208 of the feeding device 200B stores sheets P of a recording medium. The conveyance rollers 206 and 207 form a conveyance mechanism for separating an uppermost sheet P from other sheets P stored in the paper tray 208 and sequentially conveying each sheet P individually to the transfer roller 205.

In image formation, when the charger uniformly charges a surface of the photoconductor 201Y, an electrostatic latent image is formed on the photoconductor 201Y based on input image information. The development device storing yellow toner develops the electrostatic latent image into a visible yellow toner image. After being supplied with a predetermined bias, the primary transfer device primarily transfers the yellow toner image onto the transfer belt 202. Similarly, cyan, magenta, and black toner images are formed on the photoconductors 201C, 201M, and 201K, respectively and electrostatically transferred and superimposed onto the transfer belt 202 in this order to form a full color toner image.

Thereafter, the full color toner image transferred from the photoconductors 201Y, 201C, 201M, and 201K onto the transfer belt 202 is then transferred to the sheet P conveyed by the conveyance rollers 206 and 207 and the transfer roller 205. When the sheet P bearing the full color toner image is conveyed to the fixing device 100, the fixing device 100 fixes the toner image on the sheet P at a fixing nip N formed between the fixing belt 12 and the pressing roller 13. For example, when the sheet P passes through the fixing nip N, the fixing roller 11 and the pressing roller 13 are kept parallel to the driven roller 201B and the transfer roller 205, thereby properly fixing the toner image on the sheet P without creasing the sheet P.

The sheet P discharged from the fixing nip N is fed from the fixing device 100 through a sheet discharge path. In case the sheet P adheres to the fixing belt 12, a separation pawl, described later, separates the sheet P from the fixing belt 12, so that the sheet P returns to the discharge path.

According to this example embodiment, since the image forming apparatus 200 includes the fixing device 100, the image forming apparatus 200 can perform high-quality image formation without creasing the sheet P, as is described in detail below.

Figure 5:
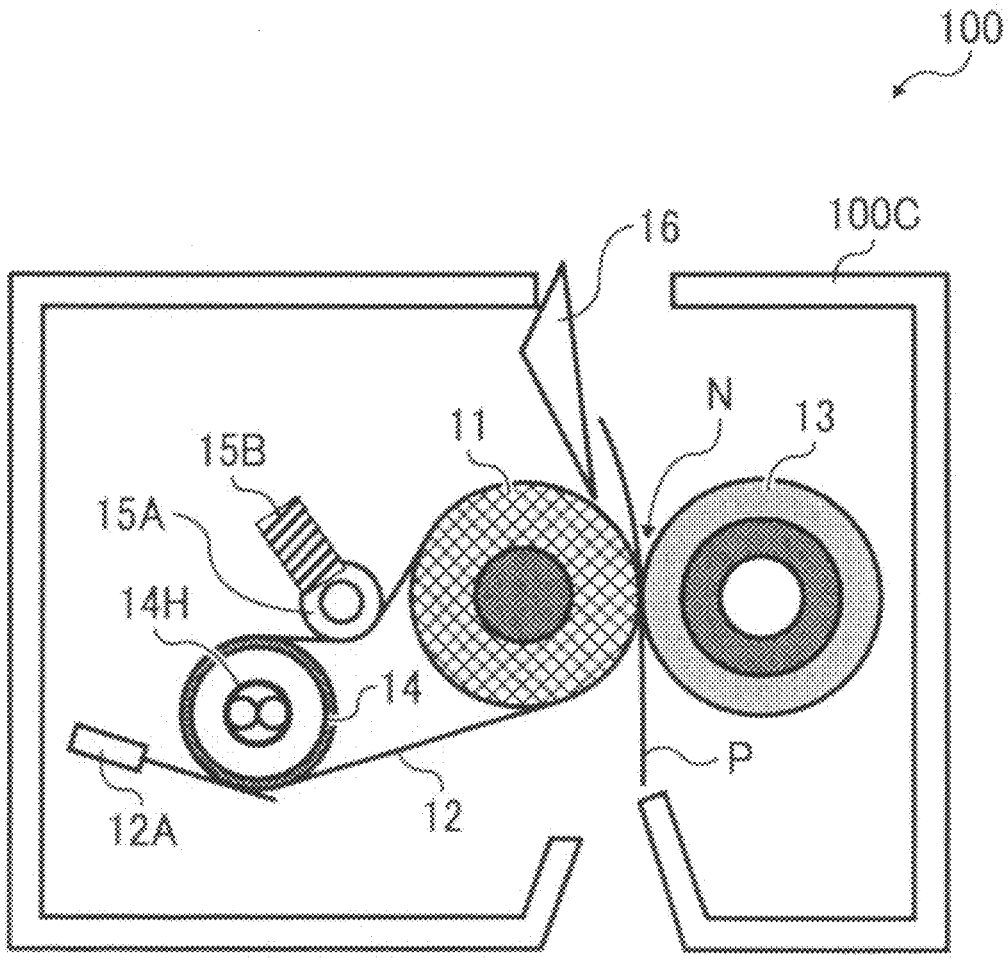
FIG. 5 is a schematic sectional view (according to an example embodiment) of a fixing device included in the image forming apparatus shown in FIG. 3.

Referring to FIG. 5, a description is now given of a structure of the fixing device 100. FIG. 5 is a schematic sectional view of the fixing device 100. The fixing device 100 further includes a cover 100C, a heating roller 14, a thermistor 12A, a separation pawl 16, a tension roller 15A, and a spring 15B. The heating roller 14 includes a built-in heater 14H.

Inside the cover 100C, the fixing belt 12 is wrapped around the fixing roller 11 and the heating roller 14 under a predetermined amount of tension. The pressing roller 13 rotatably contacts the fixing belt 12 to form the fixing nip N. The separation pawl 16 is provided on a sheet discharging side of the fixing nip N, with an edge thereof adjacent to the fixing belt 12, to prevent a sheet P from adhering to the fixing belt 12.

The fixing belt 12 has a double-layered structure, in which an elastic layer such as a silicone rubber layer is formed over a base material made of nickel, stainless steel, or polyimide, for example. Alternatively, the fixing belt 12 may have a three-layer structure in which a releasing layer made of PFA (copolymer of tetrafluoroethylene and perfluoroalkoxyethylene) or PTFE (polytetrafluoroethylene) is formed over the double-layered structure described above. The fixing roller 11 includes silicon rubber surrounding a metal core. In order to shorten warm-up time for the heating roller 14, the fixing roller 12 may include foamed silicon rubber so as to prevent absorption of heat of the fixing belt 12. The heating roller 14 is hollow and made of aluminum or iron. The heater 14H is provided inside the heating roller 14 as a heat source, and may be, but is not necessarily limited to, a halogen heater or the like. Alternatively, the heater 14H may be an IH (induction heating) mechanism.

When the fixing device 100 operates, due to rotation of the pressing roller 13 in a clockwise direction, the fixing belt 12 is driven to rotate in a direction in which the sheet P is discharged (a counterclockwise direction) under an appropriate amount of tension supplied by the tension roller 15A pressing the fixing belt 12 using the spring 15B. In fixation, due to heat generated by the heater 14H provided inside the heating roller 14, the fixing belt 12 is heated to a predetermined temperature, for example, a temperature suitable for toner fixation, detected by the thermistor 12A. It is to be noted that although the fixing device 100 includes the fixing belt 12 serving as a fixing member, alternatively the fixing device 100 may include a roller having a hollow circular cylindrical shape.

The pressing roller 13 has a cylindrical shape and includes an elastic rubber layer made of silicon rubber or the like provided around a metal core made of aluminum, iron, or the like, and a surface layer including a releasing layer made of PFA or PTFE. A pressure device presses the pressing roller 13 against the fixing belt 12 with a predetermined pressure.

When the fixing belt 12 and the pressing roller 13 are driven to rotate, the fixing belt 12 has a predetermined surface temperature. When the sheet P bearing an unfixed toner image passes through the fixing nip N in an upward direction, the unfixed toner image is heated and melted on the sheet P by heat and pressure generated at the fixing nip N, thereby fixing the toner image on the sheet P. After fixation of the toner image, when the sheet P is discharged from the fixing nip N if the sheet P adheres to the fixing belt 12, the edge of the separation pawl 16 contacts a leading edge of the sheet P, thereby separating the sheet P from the fixing belt 12. The sheet P discharged from the fixing nip N passes through a predetermined discharge path and is fed from the fixing device 100.

Figure 6A:
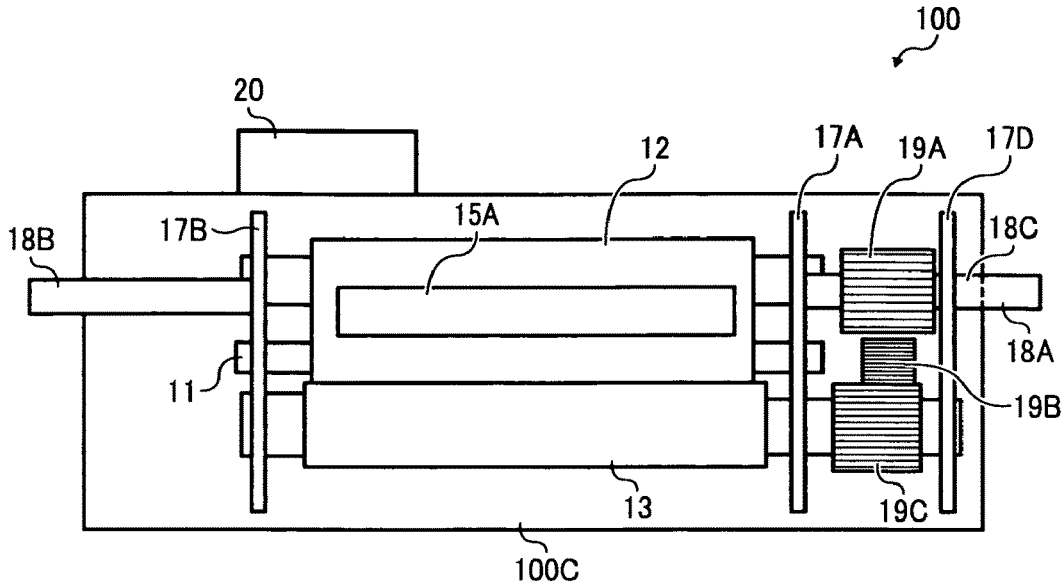
FIG. 6A is a schematic top view (according to an example embodiment) of the fixing device shown in FIG. 5.
Figure 6B:
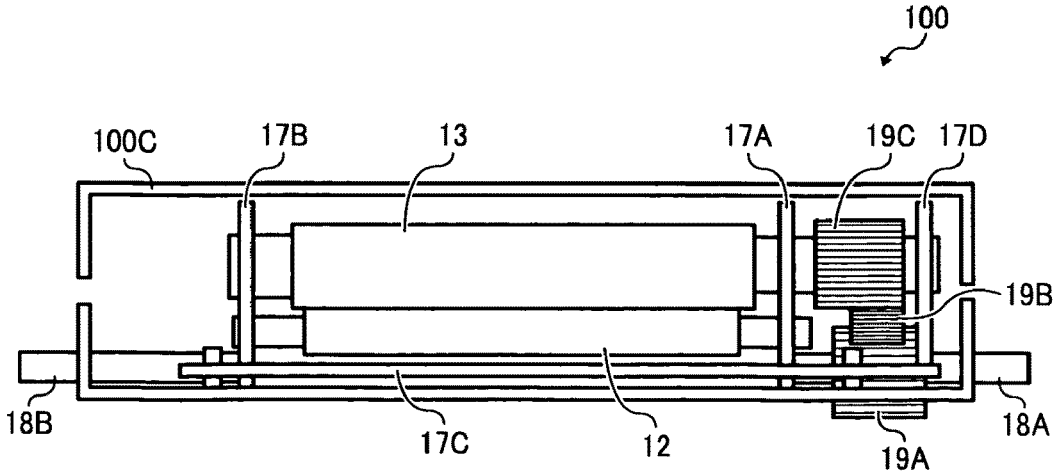
FIG. 6B is a schematic front view (according to an example embodiment) of the fixing device shown in FIG. 5A.

Referring to FIGS. 6A and 6B, a more detailed description is now given of the structure of the fixing device 100.

FIG. 6A is a top view of the fixing device 100 and FIG. 6B is a front view thereof. As illustrated in FIGS. 6A and 6B, the fixing device lob further includes side plates 17A and 17B, a bottom plate 17C, a second side plate 17D, a support shaft 18C, positioning members 18A and 18B, a drive input gear 19A, a pressing roller gear 19C, an idler gear 19B, and a drawer connector 20.

As illustrated in FIG. 6B, the side plates 17A and 17B are vertically provided on the bottom plate 17C, and support the fixing roller 11, the heating roller 14 depicted in FIG. 5, and a pressing roller 13 with a bearing. Although the side plates 17A and 17B may be either metal or resin, the side plates 17A and 17B more preferably are metal and stiff. In addition, the side plates 17A and 17B are reinforced with the bottom plate 17C, stays, and the like, so as to maintain stiffness for holding the respective rollers such that the respective rollers are kept parallel to each other. Together, the side plates 17A and 17B, the bottom plate 17C, and the stays form a frame structure, called a fixing frame.

The right side plate 17A supports the drive input gear 19A with the support shaft 18C provided in a bottom portion of the fixing device 100 and fixed on the right side plate 17A in an outward direction. The drive input gear 19A, serving as a drive input rotating body, receives a driving force input from outside, that is, the image forming apparatus 200 depicted in FIG. 4. Although the fixing device 100 includes the drive input gear 19A, the fixing device 100 may include a drive transmission mechanism including a coupling and a pulley. A rotary shaft of the pressing roller 13 extends outwards from the right side plate 17A.

The pressing roller gear 19C is provided at one end of the rotary shaft of the pressing roller 13. The idler gear 19B is provided between the drive input gear 19A and the pressing roller gear 19C to transmit torque of the drive input gear 19A to the pressing roller gear 19C, and supported by a shaft provided in the right side plate 17A. That is, when the drive input gear 19A receives a driving force transmitted from the image forming apparatus 200 to rotate, rotation of the drive input gear 19A is transmitted to the pressing roller gear 19C via the idler gear 19B to rotate the pressing roller 13. As the pressing roller 13 rotates, the fixing belt 12 is driven to rotate. Alternatively, the drive input gear 19A may directly transmit a driving force to the fixing roller 11 or the heating roller 14 to rotate the fixing roller 11 or the heating roller 14, so as to rotate the fixing belt 12.

Since the fixing device 100 is detachably attachable to the image forming apparatus 200 depicted in FIG. 4, the positioning members 18A and 18B engage supporting members of the image forming apparatus 200 to define a position of the fixing device 100. According to this example embodiment, the positioning members 18A and 18B are metallic pins having a circular cylindrical shape. Alternatively, the positioning members 18A and 18B may be resin bosses or sheet metal brackets.

The positioning member 18A is provided at one end of the support shaft 18C opposite to the other end thereof provided on the right side plate 17A (in the vicinity of the cover 100C) and combined with the support shaft 18C, so that the positioning member 18A extends from the cover 100C. That is, an outer portion of a member combining the positioning member 18A and the support shaft 18C provided outside the cover 100C is defined as a positioning member, and an inner portion thereof provided inside the cover 100C is defined as a support shaft. The positioning member 18B is provided perpendicular to the left side plate 17B and fixed thereon, with an end of the positioning member 18B in an axial direction of the positioning member 18B extending from the cover 100C. Central axes of the positioning members 18A and 18B are coaxial with a rotation center of the drive input gear 19A, respectively.

In addition, the positioning member 18A combining with the support shaft 18C has a circular cylindrical shape and is coaxial with the support shaft 18C. For example, one end of a common cylindrical shaft of the positioning member 18A and the support shaft 18C extends from the cover 100C and the other end thereof is provided perpendicular to the right side plate 17A. Therefore, since the positioning member 18A has a cylindrical shape, and the central axis thereof is coaxial with a rotation center of the drive input gear 19A, a single component combines both the positioning member 18A and the support shaft 18C of the drive input gear 19A. As a result, the number of components can be reduced, thereby providing a compact fixing device 100 at lower cost.

The second side plate 17D supports an end portion of the support shaft 18C to which the positioning member 18A is attached.

When the support shaft 18C inclines toward the right side plate 17A, the positioning member 18A combined with the support shaft 18C inclines, causing the respective rollers of the fixing device 100 to incline. As a result, the respective rollers of the fixing device 100 are not parallel to sheet conveyance rollers, that is, the transfer roller 205 and the conveyance rollers 206 and 207 of the image forming apparatus 200 depicted in FIG. 4, thereby generating a crease in the sheet P to cause a faulty image. In addition, due to inclination of the support shaft 18C of the drive input gear 19A, a distance between the central axes of the drive input gear 19A and a gear contacting the drive input gear 19A becomes smaller, thereby unevenly wearing tooth planes of the drive input gear 19A and the gear contacting the drive input gear 19A, so that the tooth of the gears may be broken.

Therefore, according to this example embodiment, the drive input gear 19A is sandwiched between the right side plate 17A and the second side plate 17D, both ends of the support shaft 18C of the drive input gear 19A are supported by the right side plate 17A and the second side plate 17D, respectively, thereby preventing the positioning member 18A combined with the support shaft 18C from inclining with respect to the right side plate 17A of the fixing frame, so that the respective rollers of the fixing device 100 are kept parallel to the sheet conveyance rollers of the image forming apparatus 200, thereby preventing generation of a crease in the sheet P passing through the fixing nip N.

Figure 7A:
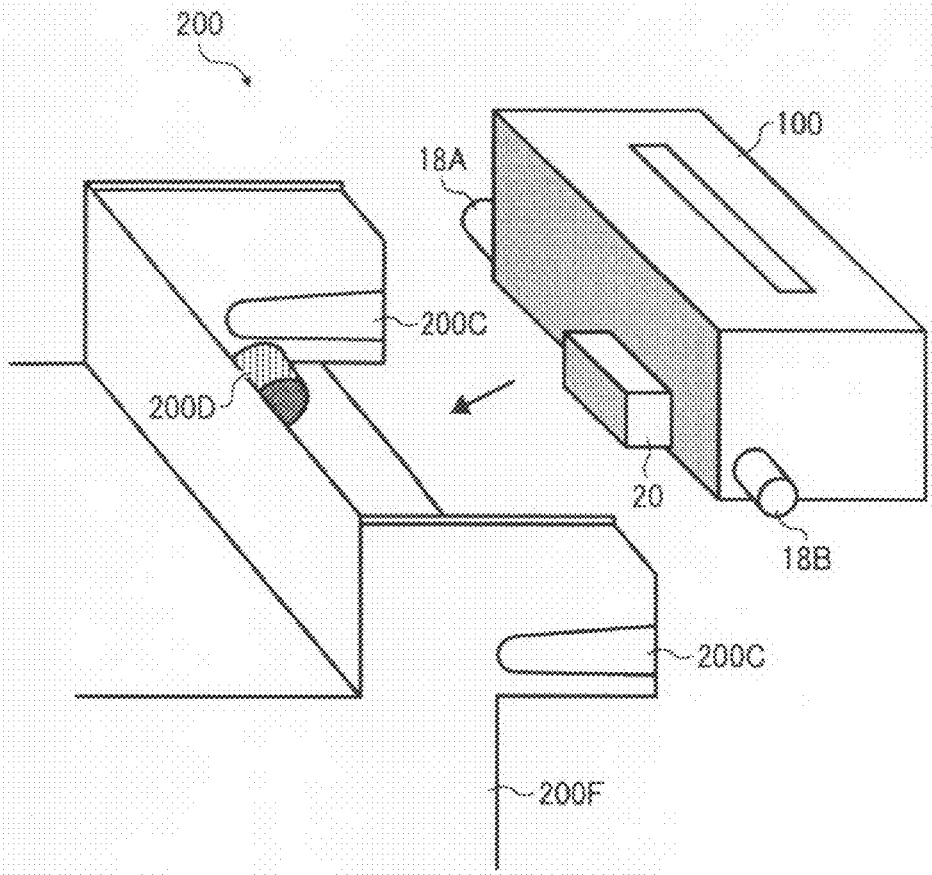
FIG. 7A is a perspective view (according to an example embodiment) of the fixing device shown in FIG. 6B and the image forming apparatus shown in FIG. 4.
Figure 7B:
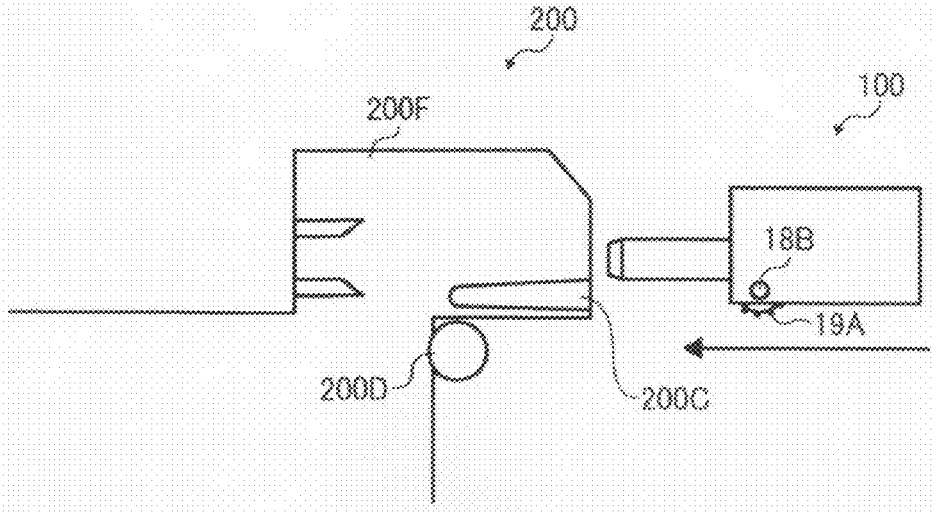
FIG. 7B is a schematic sectional view (according to an example embodiment) of the fixing device and the image forming apparatus shown in FIG. 7A.

Referring to FIGS. 7A and 7B, a description is now given of attachment of the fixing device 100 to the image forming apparatus 200.

FIG. 7A is a perspective view of the fixing device 100 and the image forming apparatus 200. FIG. 7B is a sectional view of the fixing device 100 and the image forming apparatus 200. The image forming apparatus 200 further includes a body frame 200F and a drive transmission gear 200D. The body frame 200F includes positioning grooves 200C.

When the fixing device 100 is attached to the image forming apparatus 200, a user moves the fixing device 100 in a direction perpendicular to shaft lines of the positioning members 18A and 18B and installs the fixing device 100 in a predetermined position of the image forming apparatus 200, with a surface of the fixing device 100 on which the drawer connector 20 is provided facing toward the back of the image forming apparatus 200.

The body frame 200F incorporates the transfer roller 205 and the photoconductors 201Y, 201C, 201M, and 201K depicted in FIG. 4. The positioning grooves 200C, serving as supporting members, are cut into the body frame 200F. When the fixing device 100 is attached to the image forming apparatus 200, the user can slide the positioning members 18A and 18B from front to rear using the positioning groove 200C as guide rails. Then, by engaging the positioning members 18A and 18B with end portions of the positioning grooves 200C, respectively, the fixing device 100 is installed in the predetermined position of the image forming apparatus 200. Therefore, the fixing device 100 is properly positioned relative to the transfer roller 205, the photoconductors 201Y, 201C, 201M, and 201K, and a registration roller for feeding the sheet P. That is, according to this example embodiment, shaft lines of the positioning members 18A and 18B of the fixing device 100 are parallel to the transfer roller 205 and the registration roller of the image forming apparatus 200, and the respective rollers of the fixing device 100 are kept parallel to the shaft lines of the positioning members 18A and 18B, thereby properly conveying the sheet P to the fixing device 100.

It is to be noted that a holding lever made of resin, for example, fixes the positioning members 18A and 18B, so as to engage the positioning members 18A and 18B with the positioning grooves 200C. Alternatively, a screw clamp may be used.

As illustrated in FIG. 7B, the drive transmission gear 200D is provided below the positioning groove 200C of the body frame 200F. When the fixing device 100 is installed in a predetermined position in the image forming apparatus 200, the drive transmission gear 200D engages the drive input gear 19A to transmit a driving force from the drive transmission gear 200D to the drive input gear 19A.

Figure 8:
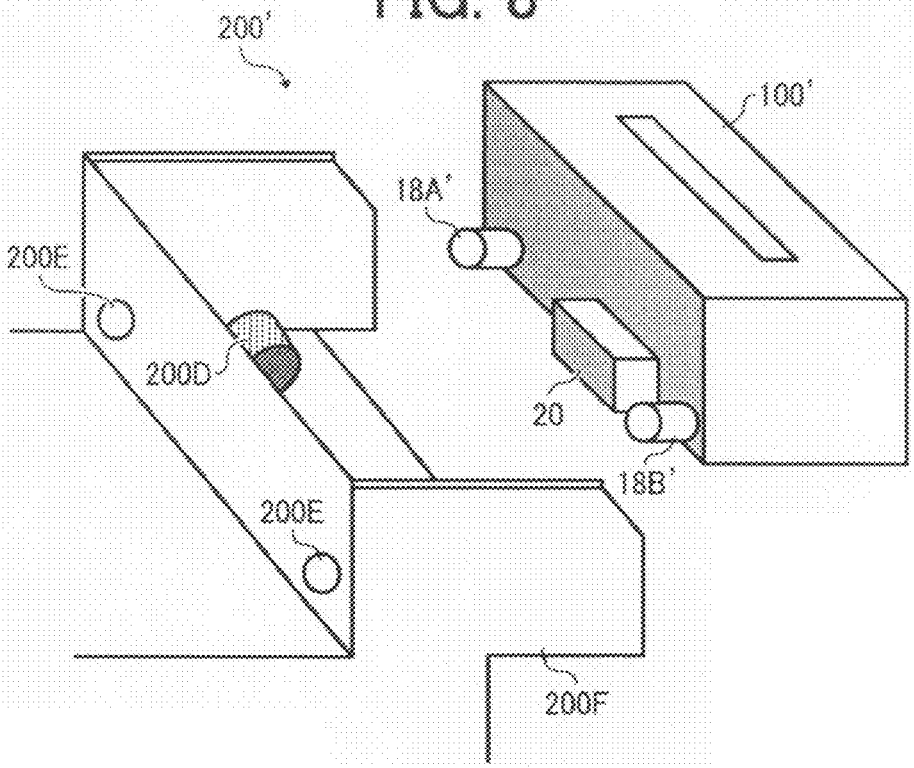
FIG. 8 is a perspective view (according to an example embodiment) of one modification of the fixing device and the image forming apparatus shown in FIG. 7A.

Referring to FIG. 8, a description is now given of a fixing device 100' as a modification of the fixing device 100.

FIG. 8 is a schematic perspective view of the fixing device 100' and an image forming apparatus 200'. The fixing device 100' includes positioning members 18A' and 18B'. The image forming apparatus 200' includes positioning holes 200E.

Although the positioning members 18A and 18B depicted in FIG. 7A extend in a width direction of the fixing device 100, the positioning members 18A' and 18B' extend from a surface of the fixing device 100' in a direction of insertion of the fixing device 100' into the image forming apparatus 200' (a surface on which the drawer connector 20 is provided). In this case, a support shaft is provided inside the fixing device 100' and combined with the positioning member 18A' to support a worm gear-type drive input gear. The positioning holes 200E, serving as supporting members, engage the positioning members 18A' and 18B' to guide the positioning members 18A' and 18B' to the body frame 200F.

Figure 9:
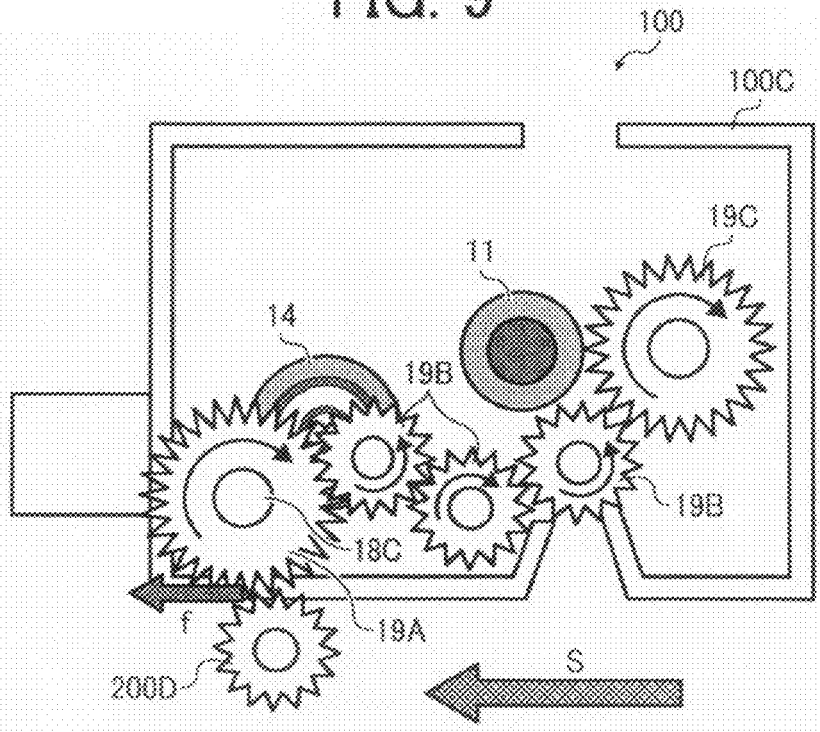
FIG. 9 is a schematic sectional view (according to an example embodiment) of the fixing device shown in FIG. 5 and a drive transmission gear included in the image forming apparatus shown in FIG. 4.

FIG. 9 is a sectional view of the fixing device 100 when attached to the image forming apparatus 200. When the drive input gear 19A receives a driving force f from the drive transmission gear 200D of the image forming apparatus 200, one part of the received force of the drive input gear 19A acts on the support shaft 18C of the drive input gear 19A and the positioning member 18A depicted in FIG. 6A. However, since the positioning member 18A is supported by the positioning groove 200C, depicted in FIG. 7A, of the image forming apparatus 200, no rotational moment m' described above with reference to FIG. 2B is generated, thereby preventing deformation of the side plates 17A and 17B of the fixing device 100 depicted in FIG. 6A.

As illustrated in FIG. 9, when the fixing device 100 is attached to the image forming apparatus 200, the positioning members 18A and 18B depicted in FIG. 7A are inserted into the positioning groove 200C depicted in FIG. 7A in a direction S substantially identical to a direction of a driving force f acting on the drive input gear 19A.

For example, when the tooth plane of the drive input gear 19A is supplied with a force acting in a direction opposite to a direction in which the fixing device 100 approaches the image forming apparatus 200, the positioning member 18A is supplied with a force in a direction opposite to a direction in which the positioning member 18A is fixed by the positioning groove 200C, thereby generating a backlash between the image forming apparatus 200 and the body frame 200F, thus causing the fixing device 100 to shift from the predetermined position in a direction in which the fixing device 100 is detached from the image forming apparatus 200, or causing the side plates 17A and 17B, serving as a frame, to be deformed.

However, according to this example embodiment, since the direction S in which the fixing device 100 is set in the image forming apparatus 200 is equal to the direction of the driving force f applied on the tooth plane of the drive input gear 19A, the positioning member 18A contacts the end portion of the positioning groove 200C of the body frame 200F, thereby preventing generation of a backlash between the image forming apparatus 200 and the body frame 200F. Accordingly, even when the fixing device 100 receives a driving force from the image forming apparatus 200, the fixing device 100 is kept in a proper position in the image forming apparatus 200, thereby preventing a failure of conveyance (generation of creases) of a transfer material, that is, the sheet P, due to lack of parallel alignment between the respective rollers of the fixing device 100 and sheet conveyance rollers of the image forming apparatus 200.

Figure 2A:
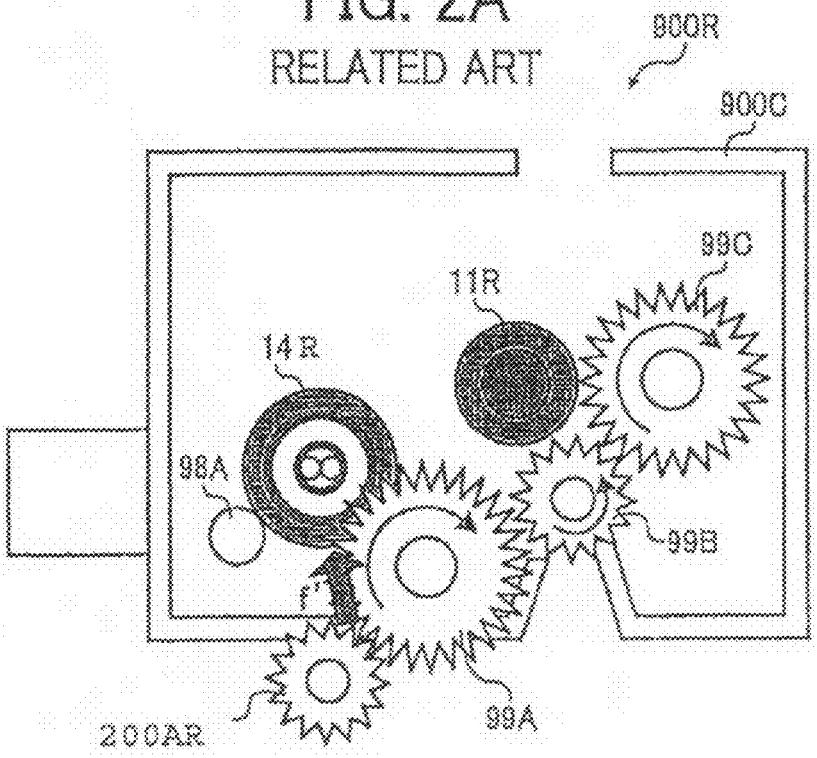
FIG. 2A RELATED ART
FIG. 2A is a schematic sectional view of the fixing device shown in FIG. 1B.
Figure 2B:
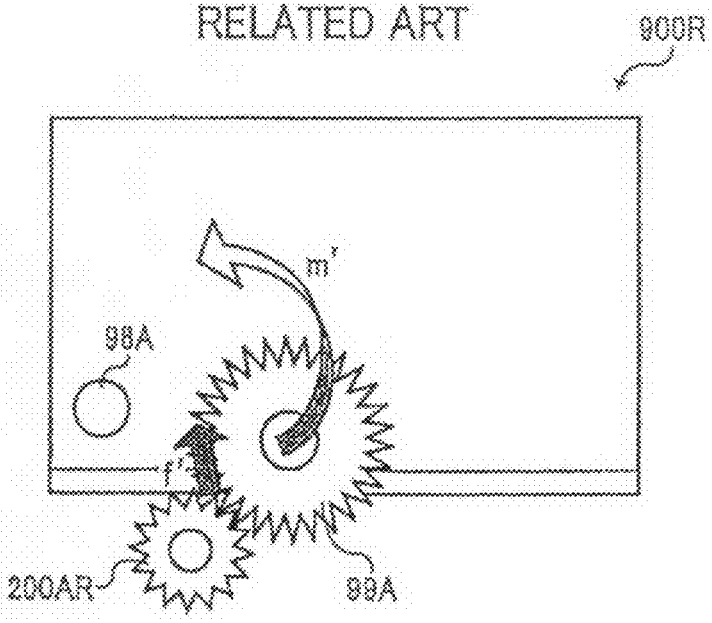
FIG. 2B RELATED ART
FIG. 2B is a schematic view of the fixing device shown in FIG. 2A.

According to the example embodiment described above, since a drive input rotating body, that is, the drive input gear 19A is supported by the support shaft 18C combined with the positioning member 18A as illustrated in FIG. 6A, even when the drive input gear 19A receives an external driving force, since the support shaft 18C is fixed to the image forming apparatus 200 via the positioning member 18A, no rotational moment m' depicted in FIG. 2B acts on the fixing device 100, thereby preventing deformation of the side plates 17A and 17B depicted in FIG. 6A, serving as a first frame. Therefore, the fixing roller 11 can be properly positioned relative to the image forming apparatus 200, so that the sheet P is stably fed to the fixing device 100, thereby preventing generation of a crease in the sheet P as well as preventing a shift of the fixing belt 12 depicted in FIG. 6A in the axial direction of the fixing belt 12.

Figure 10:
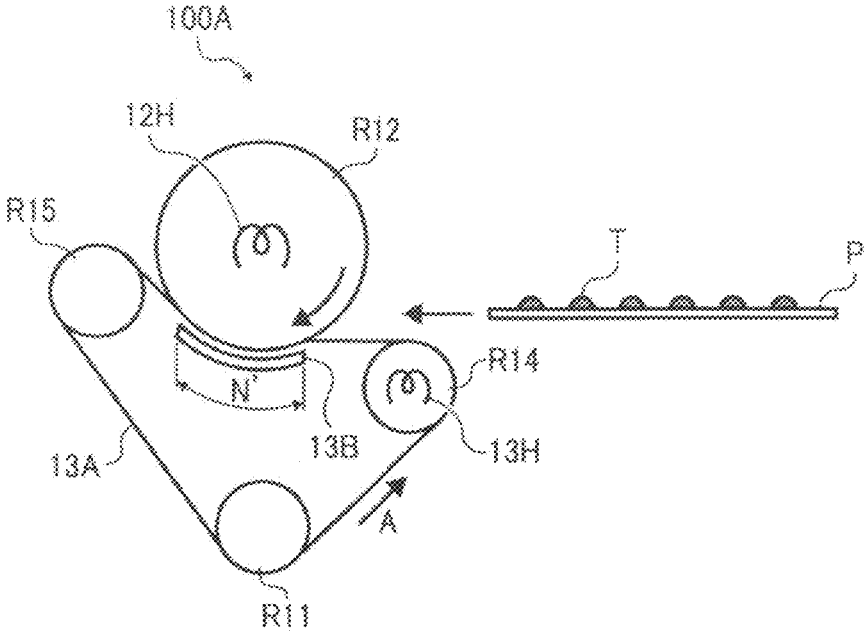
FIG. 10 is a schematic view of a fixing device according to another example embodiment.

Referring to FIG. 10, a description is now given of a fixing device 100A according to another example embodiment.

FIG. 10 is a schematic sectional view of the fixing device 100A. The fixing device 100A includes a fixing roller R12, rollers R11, R14, and R15, a pressing belt 13A, and a reinforcement member 13B. The fixing roller R12 includes a built-in heater 12H. The pressing belt 13A also includes a built-in heater 13H.

The fixing roller R12, serving as a fixing member, is rotatably provided in an upper portion of the fixing device 100A. The pressing belt 13A, serving as a pressing member, is provided under the fixing roller R12 and wrapped around the rollers R11, R14, and R15, and rotate in a direction A. The reinforcement member 13B, serving as a pressure pad, is provided on an inner surface of the pressing belt 13A. The fixing roller R12 contacts the pressing belt 13A to form a fixing nip N' therebetween. The fixing roller R12 is heated by the heater 12H as a heat source, and the pressing belt 13A is heated by the heater 13H as a heat source.

The difference between this embodiment and the previous one is that, in the present embodiment, the pressing belt 13A, serving as a pressing member, is a belt instead of a roller, and that both the fixing roller and the pressing belt each has a built-in heater, for better heating.

Figure 11:
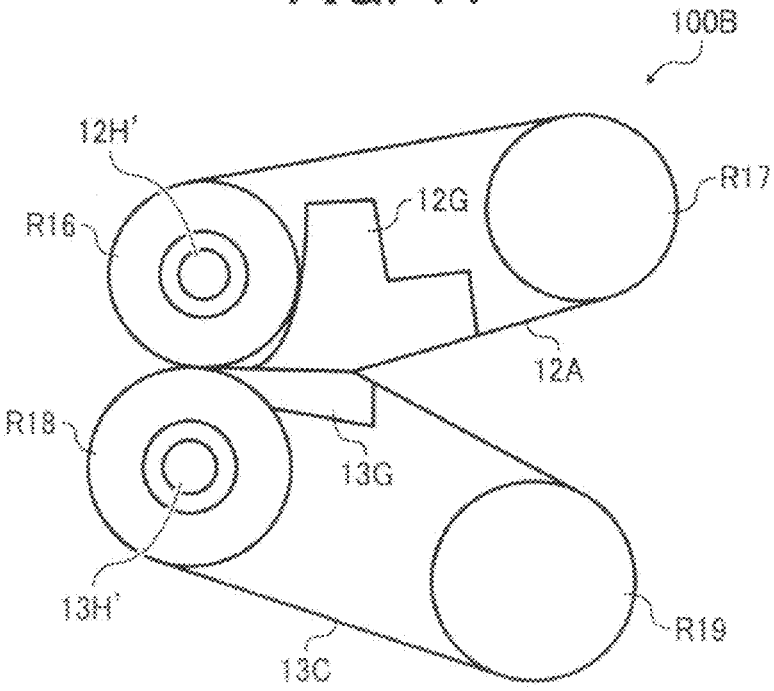
FIG. 11 is a schematic view of a fixing device according to yet another example embodiment.

Referring to FIG. 11, a description is now given of a fixing device 100B according to yet another example embodiment.

FIG. 11 is a schematic sectional view of the fixing device 100B. The fixing device 100B includes a fixing belt 12A, a pressing belt 13C, rollers R16, R17, R18, and R19, guide members 12G and 13G, and heaters 12H' and 13H'.

The fixing belt 12A, serving as a fixing member, is wrapped around the rollers R16 and R17 and the guide member 12G. As the roller R17 is driven to rotate by a driving member, the fixing belt 12A rotates. The pressing belt 13C, serving as a pressing member, is wrapped around the rollers R18 and R19 and the guide member 13G. The roller R18 opposes the roller R16 to press the pressing belt 13C and the fixing belt 12A against the roller R16. The roller R18 is driven to rotate at a peripheral speed equal to that of the roller R16. The heaters 12H' and 13H' are provided inside the rollers R16 and R18 to heat the rollers R16 and R18, respectively, thereby heating the fixing belt 12A and the pressing belt 13C.

According to the above-described example embodiment, the fixing device 100 depicted in FIG. 5 and the fixing device 100' depicted in FIG. 8 do not need any dedicated members designed to prevent the shift of the fixing belt-12, and thus the fixing devices 100 and 100' can be made more compact and component costs decreased. Due to the decrease in the number of components, warm-up time of the fixing devices 100 and 100' can be shortened.

Figure 3:
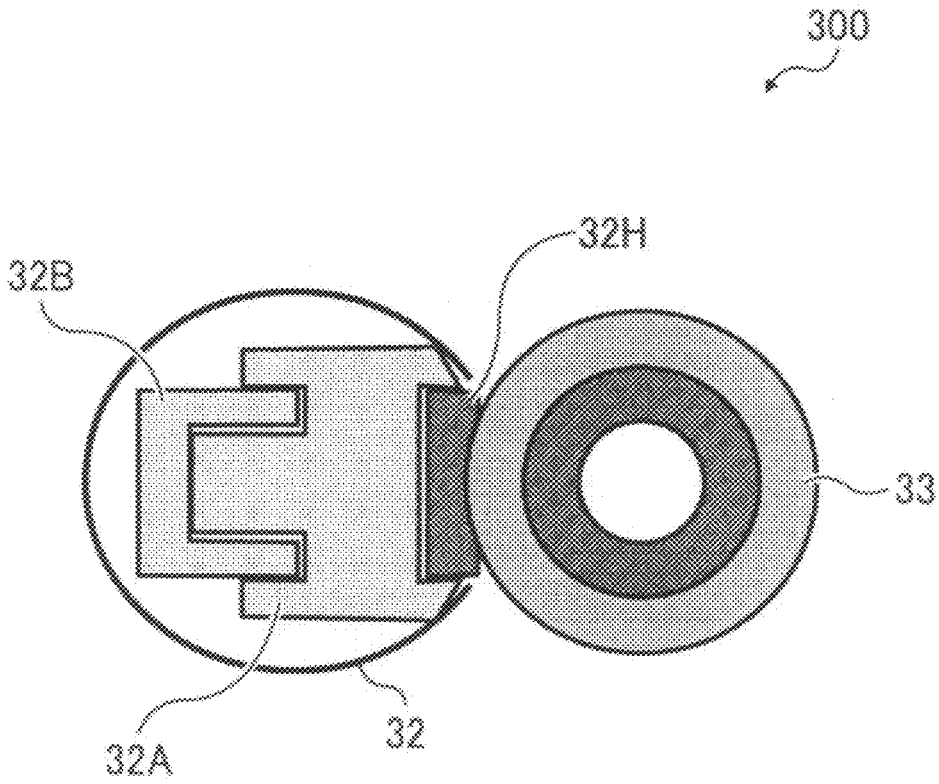
FIG. 3 RELATED ART
FIG. 3 is a schematic view of another related-art fixing device.

In addition, according to the example embodiment, since the structure of the fixing device 100 prevents deformation of the side plates 17A and 17B depicted in FIG. 6A, the pressing roller 13 depicted in FIG. 5 is kept parallel to the fixing roller 11 and the heating roller 14 supporting the fixing belt 12 depicted in FIG. 5. Therefore, even a fixing device using the surf-fixing method depicted in FIG. 3 can reduce and prevent shifting of a fixing belt. Further, according to the example embodiment, the fixing belt 12 and the pressing roller 13 of the fixing device 100 does not have a decreased frictional coefficient. Thus, when the fixing belt 12 is driven to rotate due to rotation of the pressing roller 13, the fixing belt 12 is prevented from slipping on the pressing roller 13.

Moreover, according to this example embodiment, the drive input gear 19A is stably positioned in the fixing device 100, the central axis of the drive input gear 19A keeps a proper distance from the central axis of a gear contacting the drive input gear 19A, for example, the idler gear 19B depicted in FIG. 9 or the drive transmission gear 200D depicted in FIG. 9, thereby preventing uneven wearing of the drive' input gear 19A as well as decreasing abnormal noise of the gear, so that the fixing device 100 has a longer service life than that of a conventional fixing device.

Figure 12:
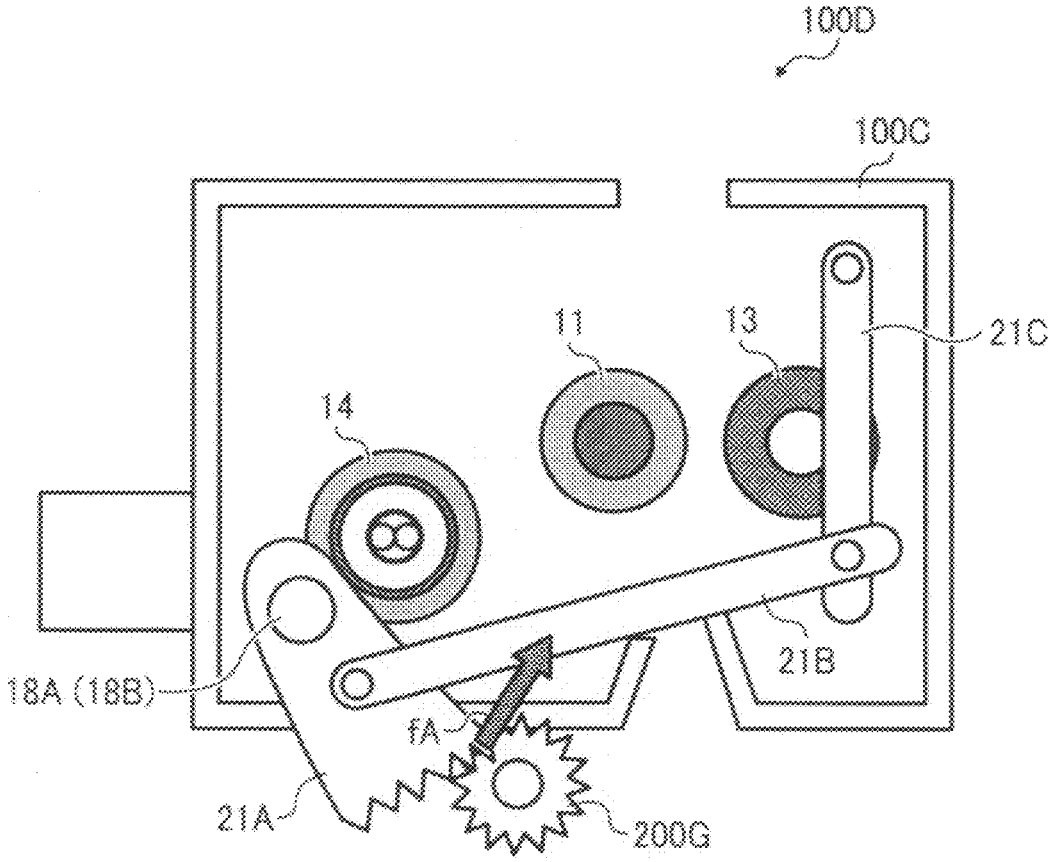
FIG. 12 is a schematic view of a fixing device according to yet another example embodiment.
Figure 13:
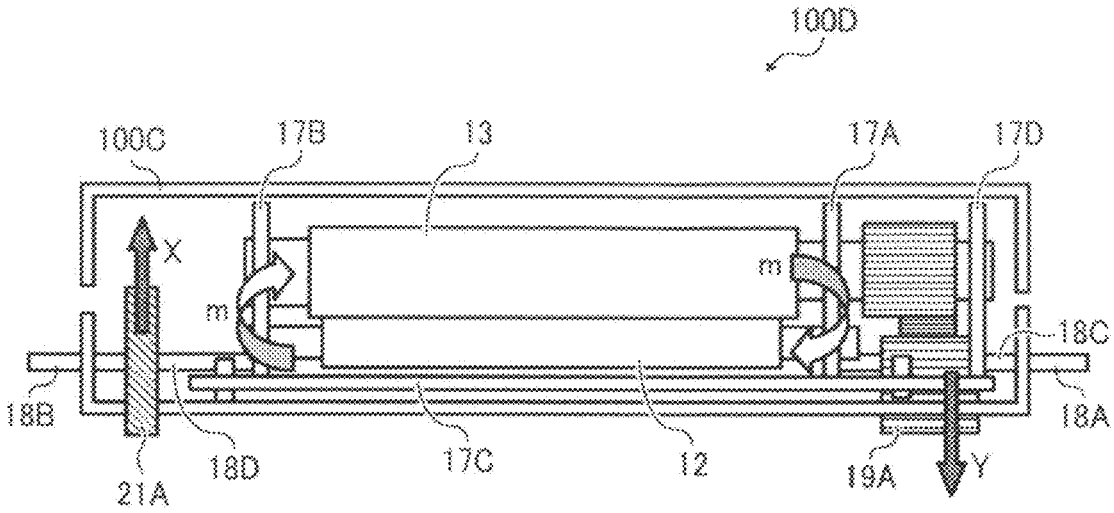
FIG. 13 is a schematic top view of the fixing device shown in FIG. 12.
Figure 14:
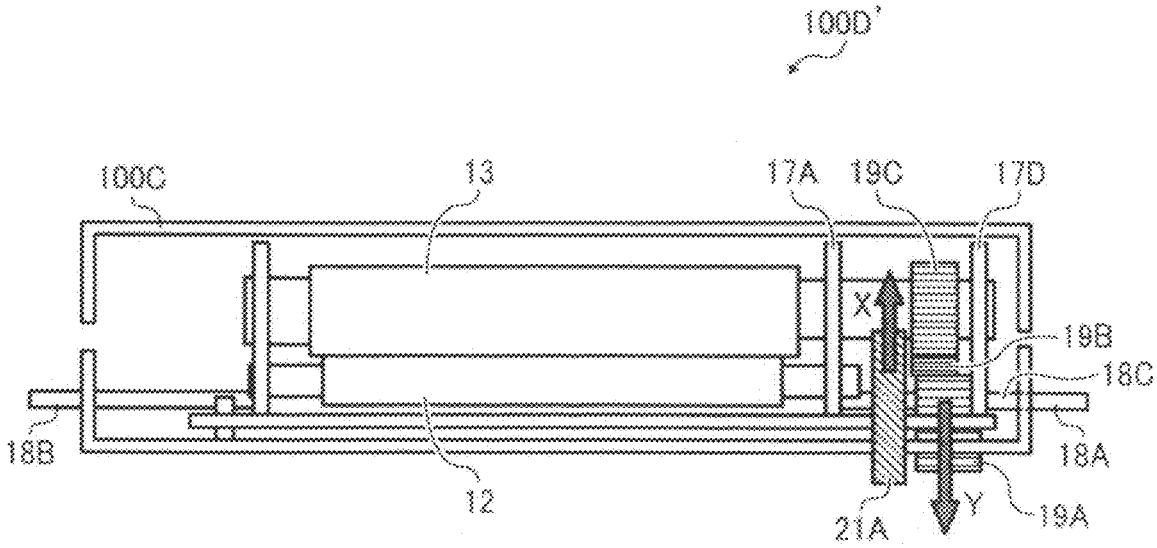
FIG. 14 is a schematic top view of one modification of the fixing device shown in FIG. 13.

A conventional fixing device uses a pressure release mechanism of a pressing roller, thereby easily removing a sheet jammed at a fixing nip by controlling a width of the nip. That is, when a driving force is transmitted from an image forming apparatus to the fixing device, a cam or the like rotates, thereby changing a pressing force of the pressing roller. When doing so, the force transmitted from the image forming apparatus causes the same problem as described above with reference to FIG. 2B when the drive input gear 99A receives the driving force f'. Therefore, according to this example embodiment, a driving force transmitted from the image forming apparatus 200 is received by a member supported by a support shaft combined with a positioning member of the fixing device 100. FIGS. 12, 13, and 14 illustrate an embodiment of such an arrangement.

Referring to FIGS. 12, 13, and 14, a description is now given of a fixing device 100D and a fixing device 100D' according to yet another example embodiment. FIG. 12 is a schematic sectional view of the fixing device 100D and FIG. 13 is a schematic front view of the fixing device 100D. FIG. 14 is a schematic front view of the fixing device 100D'.

As illustrated in FIG. 12, the fixing device 100D includes a fan-like gear 21A, a linkage 21B, a pressure lever 21C, and a pressure regulator gear 200G. As illustrated in FIG. 13, the fixing device 100D further includes support axes 18C and 18D.

The fan-like gear 21A is provided on the support shaft 18C (18D) coaxial with the positioning member 18A (18B). Upon receipt of a driving force fA from the pressure regulator gear 200G provided in the image forming apparatus 200 depicted in FIG. 4, the fan-like gear 21A swings. The linkage 21B is rotatably connected to the fan-like gear 21A. The pressure lever 21C is rotatably connected to the linkage 21B. Together, the fan-like gear 21A, the linkage 21B, the pressure lever 21C, and the pressure regulator gear 200D form a pressure release mechanism for releasing a pressing force of the pressing roller 13.

Upon receipt of the driving force from the pressure regulator gear 200G, the fan-like gear 21A cause the linkage 21B to move the pressure lever 21C. As the fan-like gear 21A rotates clockwise, the linkage 21B is pulled by the fan-like gear 21A to draw the pressure lever 21C to a pressing position. Conversely, when the fan-like gear 21A rotates counterclockwise, the pressure lever 21C moves to a pressure releasing position.

According to this example embodiment, as illustrated in FIG. 13, the fan-like gear 21A, serving as a drive transmission member, receives a driving force, other than the driving force of the fixing belt 12, from the image forming apparatus 200. The support shaft 18D, serving as a second support shaft, supports the fan-like gear 21A. The positioning member 18B is provided at an end of the support shaft 18D to combine with the support shaft 18D. Therefore, the support shaft 18D combined with the positioning member 18B supports the fan-like gear 21A, thereby preventing deformation of the side plates 17A and 17B, serving as a first frame.

However, when the support shaft 18D combined with the positioning member 18B receives one part of the driving force transmitted from the image forming apparatus 200, if the driving force is great, a deformation moment m acts on the side plates 17A and 17B, as illustrated in FIG. 13, to twist the side plates 17A and 17B to cause deformation of the side plates 17A and 17B. Therefore, as illustrated in FIG. 14, the support shaft 18C combined with the positioning member 18A receives both a driving force Y received by the drive input gear 19A and a force X (a pressure releasing force) received by the fan-like gear 21A.

Therefore, as illustrated in FIG. 14, in the fixing device 100D', the fan-like gear 21A, serving as a drive transmission member, receives a driving force, other than the driving force of the fixing belt 12, from the image forming apparatus 200, and is supported by the support shaft 18C supporting the drive input gear 19A, serving as a drive input rotating body. That is, the fan-like gear 21A for releasing a pressing force of the pressing roller 13 is adjacent to the drive input gear 19A in a width direction of the fixing device 100D', so that the support shaft 18C supports both the fan-like gear 21A and the drive input gear 19A. Therefore, for example, as illustrated in FIG. 14, even when the fan-like gear 21A receives the force X while the drive input gear 19A receives the force Y in a direction opposite to a direction of the force X, both the forces combine with each other in the support shaft 18C without being transmitted to the side plates 17A and 17B, that is, both forces cancel each other out, thereby preventing generation of the moment m causing deformation of the side plates 17A and 17B.

An evaluation test was performed using the fixing device 100 depicted in FIG. 6A when provided in the image forming apparatus 200 depicted in FIG. 4 to examine whether the fixing belt 12 shifts from a predetermined position in an axial direction of the fixing belt 12. The test conditions were as follows:

Fixing roller 11: diameter of 30 mm, structure=silicon sponge

Pressing roller 13: diameter of 30 mm, structure=lamination of metal core, elastic layer (solid rubber), and releasing layer (PFA)

Heating roller 14: diameter of 20 mm, structure=aluminum

Fixing belt 12: diameter of 45 mm, structure=PI (polyimide)

Linear velocity: 150 mm/s

For comparison, a similar test was performed using the fixing device 900R depicted in FIG. 1A when provided in the image forming apparatus 200 under the same conditions as above.

As a result of the test on the fixing device 900R, the fixing belt 12R shifted from a predetermined position in an axial direction of the fixing belt 12R at a velocity of 0.6 mm/s. However, in the fixing device 100, the fixing belt 12 did not shift from a predetermined position in the axial direction of the fixing belt 12, or at most the fixing belt 12 shifted from the predetermined position at a velocity of 0.1 mm/s at a maximum, not greater than one-sixth of the velocity seen in the fixing device 900R, thereby preventing or at least substantially preventing a shift of the fixing belt 12 in the axial direction of the fixing belt 12.

The present invention has been described above with reference to specific example embodiments. Nonetheless, the present invention is not limited to the details of example embodiments described above, but various modifications and improvements are possible without departing from the spirit and scope of the present invention. The number, position, shape, and the like, of the above-described constituent elements are not limited to the above-described example embodiments, but may be modified to the number, position, shape, and the like, which are appropriate for carrying out the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device for fixing an unfixed toner image on a sheet while conveying the sheet, comprising:

a rotatable fixing member;

a pressing member to contact the fixing member to form a fixing nip therebetween;

a drive input rotating body to receive an external driving force and transmit the driving force to the fixing member;

a first frame to support the fixing member and the pressing member;

a support shaft provided on the first frame to support the drive input rotating body;

at least one positioning member supported by an image forming apparatus body when the fixing device is installed in the image forming apparatus body, the at least one positioning member being combined with an end of the support shaft in an axial direction of the support shaft; and a second frame disposed facing the first frame with the at least one positioning member interposed therebetween, the second frame supporting the end of the support shaft together with the first frame.

2. The fixing device according to claim 1, wherein the at least one positioning member combined with the end of the support shaft is cylindrical in shape and coaxial with the support shaft.

3. The fixing device according to claim 1, further comprising:

a drive transmission member to receive an external driving force other than the driving force of the fixing member; and a second support shaft to support the drive transmission member, wherein the at least one positioning member is combined with an end of the second support shaft in an axial direction of the second support shaft.

4. The fixing device according to claim 1, further comprising:

a drive transmission member supported by the support shaft supporting the drive input rotating body to receive an external driving force other than the driving force of the fixing member.

5. The fixing device according to claim 1, wherein the fixing member is a belt wrapped around a plurality of rollers.

6. The fixing device according to claim 1, wherein the pressing member is a belt wrapped around a plurality of rollers.

7. The fixing device according to claim 1, wherein the first frame includes a bottom plate to provide reinforcement and maintain stiffness.

8. The fixing device according to claim 1, wherein the first frame is made from at least one of metal and resin.

9. The fixing device according to claim 1, further comprising a pressing roller gear provided at one end of the pressing member.

10. The fixing device according to claim 9, further comprising an idler gear provided between the drive input rotating body and the pressing roller gear to transmit so as to transmit the driving force of the drive input rotating body to the pressing roller gear.

11. The fixing device according to claim 1, wherein the drive input rotating body directly transmits the driving force to the fixing member so as to rotate a fixing belt.

12. The fixing device according to claim 1, wherein the at least one positioning member combines with the support shaft has a circular cylindrical shape and coaxial with the support shaft.

13. An image forming apparatus, comprising:

a fixing device to fix an unfixed toner image on a sheet while conveying the sheet, the fixing device comprising:

a rotatable fixing member;

a pressing member to contact the fixing member to form a fixing nip therebetween;

a drive input rotating body to receive an external driving force and transmit the driving force to the fixing member;

a first frame to support the fixing member and the pressing member;

a support shaft provided on the first frame to support the drive input rotating body; and at least one positioning member supported by an image forming apparatus body when the fixing device is installed in the image forming apparatus body, the at least one positioning member being combined with an end of the support shaft in an axial direction of the support shaft;

a supporting member to engage the positioning member of the fixing device to support the fixing device; and a second frame disposed facing the first frame with the at least one positioning member interposed therebetween, the second frame supporting the end of the support shaft together with the first frame.

14. The image forming apparatus according to claim 13, wherein, when the fixing device is installed in the image forming apparatus body, the at least one positioning member is inserted into the supporting member in a direction substantially identical to a direction of the driving force acting on the drive input rotating body of the fixing device.

15. The fixing device according to claim 13, wherein the at least one positioning member combined with the end of the support shaft is cylindrical in shape and coaxial with the support shaft.

16. The fixing device according to claim 13, further comprising:

a drive transmission member to receive an external driving force other than the driving force of the fixing member; and a second support shaft to support the drive transmission member, wherein the at least one positioning member is combined with an end of the second support shaft in an axial direction of the second support shaft.

17. The fixing device according to claim 13, further comprising:

a drive transmission member supported by the support shaft supporting the drive input rotating body to receive an external driving force other than the driving force of the fixing member.

18. The fixing device according to claim 13, wherein the fixing member is a belt wrapped around a plurality of rollers.

19. The fixing device according to claim 13, wherein the pressing member is a belt wrapped around a plurality of rollers.

* * * * *